US007789229B2

(12) United States Patent
Frakes

(10) Patent No.: US 7,789,229 B2
(45) Date of Patent: Sep. 7, 2010

(54) MAGNETIC TOOL HOLDER

(76) Inventor: Alexander Frakes, 2470 E. County Rd., Carthage, IL (US) 62321

( * ) Notice: Subject to any disclaimer, the term of this patent is extended or adjusted under 35 U.S.C. 154(b) by 402 days.

(21) Appl. No.: 11/758,220

(22) Filed: Jun. 5, 2007

(65) Prior Publication Data

US 2008/0302689 A1 Dec. 11, 2008

(51) Int. Cl.
*B65D 85/00* (2006.01)

(52) U.S. Cl. ..... 206/350; 206/373; 206/818

(58) Field of Classification Search ..... 206/349, 206/350, 372–379, 443, 818; 220/483, 230, 220/504, 506, 524
See application file for complete search history.

(56) References Cited

U.S. PATENT DOCUMENTS

| | | | | | |
|---|---|---|---|---|---|
| 378,928 | A * | 3/1888 | Goldsmith | 206/214 |
| 2,351,815 | A * | 6/1944 | Jensen | 206/379 |
| 2,589,349 | A * | 3/1952 | Diefenbach | 220/483 |
| 2,919,796 | A * | 1/1960 | Pressl | 206/379 |
| 3,556,341 | A * | 1/1971 | Rains | 220/483 |
| 4,767,006 | A * | 8/1988 | Wasem | 206/376 |
| 5,054,668 | A * | 10/1991 | Ricchiuti | 206/818 |
| 5,368,203 | A * | 11/1994 | Friedrich et al. | 206/818 |
| 5,405,004 | A * | 4/1995 | Vest et al. | 206/350 |
| 6,237,767 | B1 * | 5/2001 | Lee | 206/373 |
| D456,990 | S * | 5/2002 | Lusty | D3/228 |
| 6,839,974 | B1 * | 1/2005 | Hitchcock | 33/473 |
| 2005/0056646 | A1 * | 3/2005 | Gary | 220/483 |

* cited by examiner

*Primary Examiner*—J. Gregory Pickett
(74) *Attorney, Agent, or Firm*—Preston H. Smirman; Smirman IP Law, PLLC

(57) ABSTRACT

A magnetic tool holder includes a body having an area defining a cavity, the body including an inner surface and an outer surface, a magnet disposed on the outer surface of the body, wherein the magnet is operable to releasably adhere the body to a magnetic surface, an insert, wherein the insert is operable to be received within the cavity, wherein the insert includes at least one area defining a compartment, at least one tool, wherein the tool is selectively operable to be received within the compartment, and a cap, wherein the cap is selectively operable to engage an end portion of the outer surface of the body, wherein a magnet is disposed on an outer surface of the cap, wherein the magnet is operable to releasably adhere the cap to a magnetic surface.

3 Claims, 2 Drawing Sheets

MAGNETIC TOOL HOLDER

FIELD OF THE INVENTION

The present invention relates generally to tool holders, and more particularly to new and improved magnetic tool holders, wherein a variety of different tools or other devices can be received within a container, wherein one or more exterior surfaces of the container can include one or more magnets associated therewith, such that the magnets can releasably adhere a surface of the container to a suitable magnetic surface.

BACKGROUND OF THE INVENTION

Tool holders are typically used to house various tools, especially those that come in sets, such as wrenches, screwdrivers, pliers, and the like. In certain situations, placing a tool holder on the ground or other surface can be undesirable, as the tool holder, and the tools contained therein, can get wet (e.g., if working in a wet environment such as a flooded basement), can get soiled or contaminated (e.g., if working in filthy environment such as a sewer), or can get blown away (e.g., if working in a windy environment such as on an open building superstructure). In each of these situations, the user would prefer not to place the tool holder down on any surfaces that could allow for any damage, obscuring, or carrying off the tool holder.

Therefore, there exists a need for new and improved tool holders that overcome at least one of the aforementioned problems.

SUMMARY OF THE INVENTION

In accordance with the general teachings of the present invention, new and improved magnetic tool holders are provided.

In one aspect of the invention, the magnetic tool holder includes a body having an area defining a cavity, the body including an inner surface and an outer surface, and a magnet disposed on the outer surface of the body, wherein the magnet is operable to releasably adhere the body to a magnetic surface.

An insert can also be provided, wherein the insert is operable to be received within the cavity. The insert can include at least one area defining a compartment, and can include a plurality of compartments. At least one tool can be selectively received within the compartment.

A cap can also be provided, wherein the cap can engage an end portion of the outer surface of the body. A magnet can be disposed on an outer surface of the cap, wherein the magnet can releasably adhere the cap to a magnetic surface. The end portion of the outer surface of the body can be provided with a threaded surface and an inner surface of cap can be provided with a threaded surface. The threaded surface of the cap and the threaded surface of the body can be brought into threaded engagement. Another cap can be provided, wherein the other cap can engage another end portion of the outer surface of the body.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following description of the preferred embodiment(s) is merely exemplary in nature and is in no way intended to limit the invention, its application, or uses.

Figure 1:
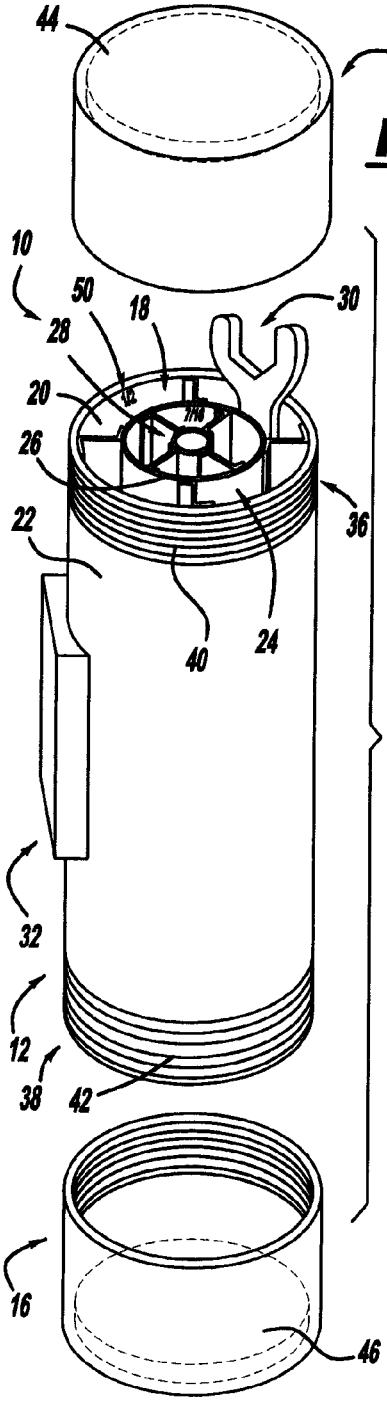
FIG. 1 illustrates an exploded view of a magnetic tool holder.
Figure 4:
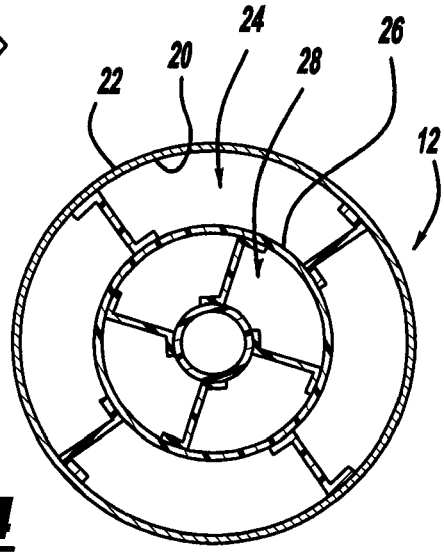
FIG. 4 illustrates a sectional view taken along line 4-4 of FIG. 3 showing an insert disposed in an interior cavity of a magnetic tool holder.

Referring to the drawings generally and specifically to FIGS. 1 and 4, there is shown an exploded view of a magnetic tool holder 10, in accordance with one embodiment of the present invention. The tool holder 10 includes a body 12, a top cap 14 and a bottom cap 16 (the use of top and bottom in this case is for reference purposes only).

The body 12 is shown as being substantially cylindrical, but other shapes are envisioned, such as oval, square, rectangular, and/or the like. The body 12 can be constructed of any number of materials, such as but not limited to metals, ceramics, plastics, rubbers, foams, and/or the like. The body 12 includes an area defining a cavity 18. The body 12 also includes an inner surface 20 and an outer surface 22.

The cavity 18 is configured to be able to receive an insert 24 such that a portion of the insert 24 is able to abut the inner surface 20, e.g., to steady the insert 24 to keep it from shifting position within the cavity 18. The length of the insert 24 can be variable, but can extend the length of the body 12, the combined length of the body 12 and the bottom cap 16, the combined length of the body 12 and the top cap 14, and the combined length of the body 12, the top cap 14 and the bottom cap 16. The insert 24 can be configured in any number of shapes. The insert 24 can be constructed of any number of materials, such as but not limited to metals, ceramics, plastics, rubbers, foams, and/or the like.

By way of a non-limiting example, the insert 24 can be configured from a series of concentric intersecting or abutting arc-shaped members 26 that form several individual compartments 28. Alternatively, the compartments can be shaped in any number of configurations, including ovals, squares, rectangles, circles, and/or the like. Into these compartments, any number of different types of tools 30 (e.g., wrenches, screwdrivers, pliers, and/or the like) can be securely received, as will be described in more detail.

Figure 3:
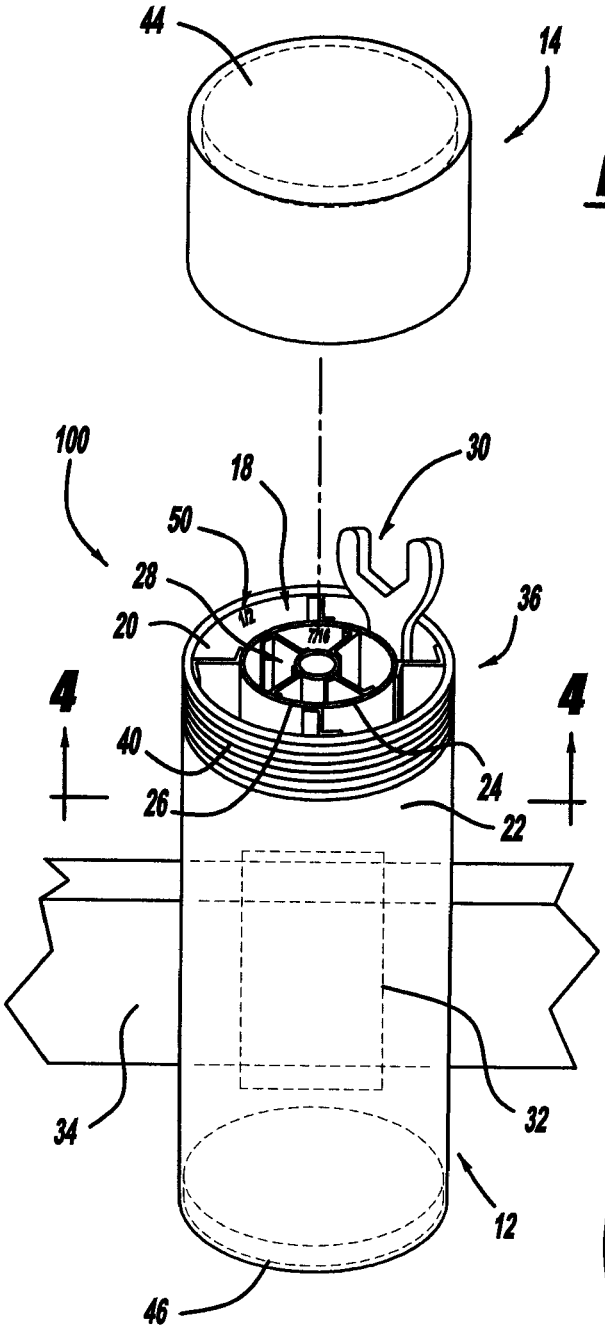
FIG. 3 illustrates a partially exploded view of an alternative magnetic tool holder wherein a side surface thereof is magnetically attached to a surface.

On the outer surface 22, a magnet 32 (comprised of magnetic material) is associated therewith. The magnet 32 can be disposed within the outer surface 22 (e.g., in a flush or coplanar arrangement) or can be raised away from the surface of the outer surface 22. Referring to FIG. 3, one intended purpose of the magnet 22 is to allow the body 12 to be placed against a surface 34 such that the body 12 is removably fastened to the surface 34. By way of a non-limiting example, the magnet 32 can be used in conjunction with surfaces that include magnetic materials (e.g., certain magnetic or magnetic-like materials such as certain metals (e.g., iron, cobalt, nickel and their alloys), ceramics, and/or the like) such that the two respective materials are attracted to one another. In this manner, the body 12 can be placed against a magnetic surface such that the body 12 will be held securely and safely in place and can be easily removed from the surface by pulling.

The respective caps 14 and 16 are intended to cooperate with the respective outer end portions 36 and 38 of the body 12. By way of a non-limiting example, the end portions 36 and 38 are provided with threaded surfaces 40, 42, respectively. Each of the inner surfaces of the caps 14 and 16 are also provided with threaded surfaces 44 that are intended to threadingly engage or mate with the threaded surfaces 40, 42, respectively. It should be noted that the top cap 14 and bottom cap 16 can be configured so as to interchangeable, thus the top cap 14 can mate or engage threaded surface 42 and bottom cap 16 can mate or engage threaded surface 40. Alternatively, caps 14 and 16 can frictionally engage either of end portions 36, 38, respectively, without the need for threaded surfaces.

Figure 2:
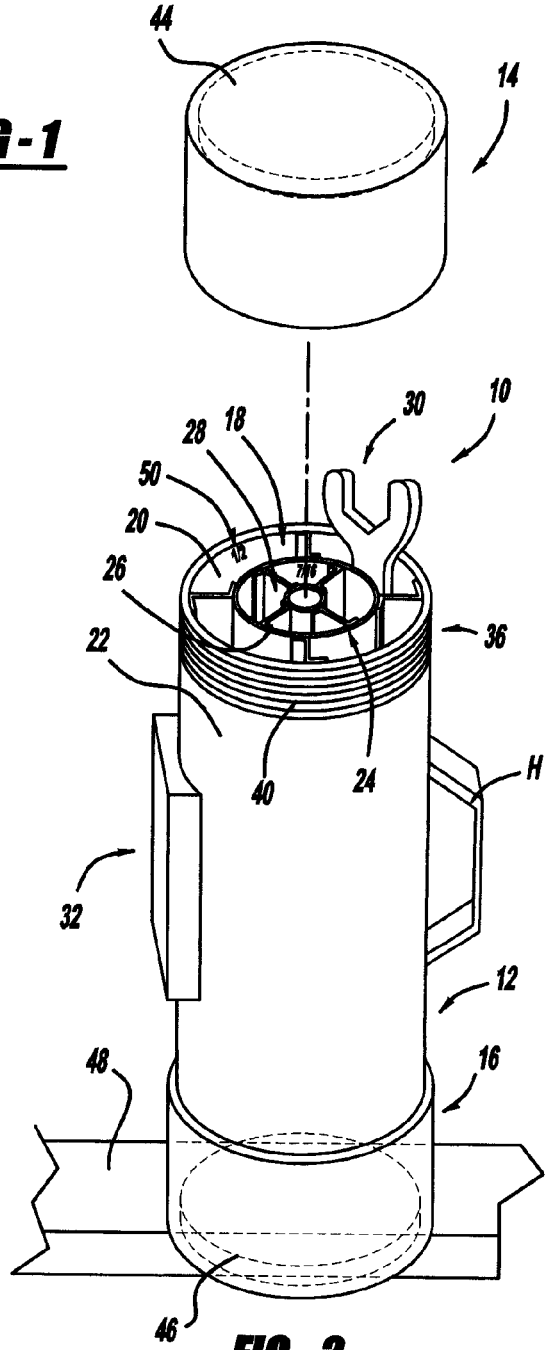
FIG. 2 illustrates a partially exploded view of a magnetic tool holder wherein a bottom surface thereof is magnetically attached to a surface.

On an exterior surface of either of top cap 14 or bottom cap 16, a magnet 44, 46, respectively, can be disposed, e.g., either in a flush or raised arrangement. Referring to FIG. 2, one intended purpose of the magnets 44, 46, respectively, is to allow either the top cap 14 or bottom cap 16 to be placed against a surface 48 such that either the top cap 14 or bottom cap 16 is removably fastened to the surface 48. By way of a non-limiting example, the magnets 44, 46, respectively, can be used in conjunction with surfaces that include magnetic materials (e.g., certain magnetic or magnetic-like materials such as certain metals (e.g., iron), ceramics, and/or the like) such that the two respective materials are attracted to one another. In this manner, either the top cap 14 or bottom cap 16 can be removed from the body 12 and placed against a magnetic surface such that either the top cap 14 or bottom cap 16 will be held securely and safely in place and can be easily removed from the surface by pulling. Additionally, an optional handle H can be provided on an exterior surface of the body 12 to facilitate transport of any of the magnetic tool holders of the present invention.

Referring to FIG. 3 again, an alternative tool holder 100 includes a body 12 that does not include a bottom cap (but can still include magnet 46 disposed on a bottom exterior surface of the body 12), but rather only includes a top cap 14 (the use of top and bottom in this case is for reference purposes only). In this manner, only one access point exists for the tools 30 disposed within the insert 24 of the body 12.

The inner surface 20 of the body 12 can also include indicia 50 disposed thereon which indicate information (e.g., size, length, and/or the like) about the tool 30 disposed in one of the outer or larger compartments 28 in proximity to those indicia 50. Additionally, the indicia 50 can also be provided on a surface of the insert 24, so that tools 30 disposed in one of the inner or smaller compartments 28 can be readily identified by the user.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A magnetic tool holder, comprising:

a body having an area defining a cavity, the body including an inner surface and an outer surface, the body including an open first end portion and a spaced and opposed open second end portion;

a magnet disposed on the outer surface of the body;

wherein the magnet is operable to releasably adhere the body to a magnetic surface;

an insert, wherein the insert is operable to be received within the cavity;

wherein the insert includes at least one area defining a plurality of compartments, wherein at least a portion of the insert extends substantially the length of the body;

a first cap, wherein the first cap is selectively operable to releasably engage the first or second end portion of the body; and a second cap, wherein the second cap is selectively operable to releasably engage the first or second end portion of the body;

wherein the first or second cap is selectively operable to engage the first or second end portion of the outer surface of the body, wherein a magnet is disposed on a surface of the first or second cap, wherein the magnet is operable to releasably adhere the first or second cap to a magnetic surface.

2. The invention according to claim 1, wherein the first or second end portion of the outer surface of the body is provided with a threaded surface, wherein an inner surface of the first or second cap is provided with a threaded surface, wherein the threaded surface of the first or second cap and the threaded surface of the first or second end portion of the body are brought into threaded engagement.

3. The invention according to claim 1, further comprising indicia disposed on the inner surface of the body or the insert.

* * * * *